US005337578A

United States Patent [19]

Ptacek et al.

[11] Patent Number: 5,337,578

[45] Date of Patent: Aug. 16, 1994

[54] TRAPPED AIR MONITOR FOR A REFRIGERANT RECOVERY UNIT

[75] Inventors: Fred L. Ptacek, Joshua; George R. Outlaw, Arlington; Charles R. Smith, Grapevine, all of Tex.

[73] Assignee: Wynn's Climate Systems, Inc., Fort Worth, Tex.

[21] Appl. No.: 19,786

[22] Filed: Feb. 19, 1993

[51] Int. Cl.[5] ..... F25B 43/04

[52] U.S. Cl. ..... 62/195; 62/475

[58] Field of Search ..... 62/85, 195, 495, 292, 62/126, 127, 129

[56] References Cited

U.S. PATENT DOCUMENTS 2,321,964 6/1943 Zeiber .
3,131,546 5/1964 Osborne .
3,145,544 8/1964 Weller .
3,170,631 2/1965 Whitlow .
3,230,729 1/1966 Eber .
3,410,106 11/1968 Brockie .
3,592,017 7/1971 Lipman et al. .
3,620,038 11/1971 Muench .
3,664,147 5/1972 Blackmon .
4,304,102 12/1981 Gray .
4,513,578 4/1985 Proctor et al. .
4,531,375 7/1985 Zinsmeyer .
4,534,320 8/1985 MacArthur et al. .
4,768,347 9/1988 Manz et al. .
4,776,175 10/1988 Romijn .
4,856,288 8/1989 Weber .
5,005,369 4/1991 Manz .

*Primary Examiner*—John Sollecito
*Attorney, Agent, or Firm*—Grady K. Bergen; James E. Bradley

[57] ABSTRACT

A monitor used in refrigerant recovery systems to detect and reduce non-condensable vapor in a storage container. The monitor has a sampling reservoir that draws a sample of liquid refrigerant contained in a storage container. The sample of liquid refrigerant is allowed to reach equilibrium, providing a saturated vapor pressure, which is compared to the vapor pressure in an upper portion of the container. The difference in pressure between the sampling reservoir and the container indicating when the container should be exhausted.

5 Claims, 1 Drawing Sheet

TRAPPED AIR MONITOR FOR A REFRIGERANT RECOVERY UNIT

BACKGROUND OF THE INVENTION

1. Field of the Invention

This invention relates to an apparatus for determining the amount of air and other non-condensable vapors that are collected along with liquid and vapor refrigerant in a storage container of a refrigerant recovery unit.

2. Description of the Prior Art

Because of the present environmental concerns due to the fluorocarbons found in most refrigerants, the collection and recycling of refrigerant has become a very important practice. This creates a need for collecting refrigerant from refrigeration systems in appropriate containers so that the refrigerant may be properly recycled. When refrigerant is collected from a refrigeration unit, air and other non-condensable vapors also collect in the storage container. These non-condensable vapors may collect and build up in the storage container so that the container must be vented off or purged.

There are a variety of different purge systems that have been used in refrigeration storage units. These usually involve some type of purge valve that is connected to the container where non-condensable vapor from a condenser or some other component of the refrigeration system builds up. As the amount of non-condensable vapor in the container increases, the valve opens causing the non-condensable vapors to be vented off.

A variety of methods are used to determine when the vapors should be vented. A common method involves measuring a pressure differential between the container and the atmosphere. The container is vented when this pressure differential reaches a predetermined point. Some purge systems measure the saturated vapor pressure of a permanently sealed refrigerant sample that is brought to the temperature of the refrigerant where the non-condensable vapor builds up, such as a storage container. A pressure differential is then measured between the container and the sample. When the pressure exceeds a predetermined amount, the container is vented. Other methods involve measuring time, temperature, fluid levels, flow rates or other variables that would indicate how much non-condensable vapor has built up.

SUMMARY OF THE INVENTION

This invention provides a monitor for determining when non-condensable vapors should be vented from a container used for collecting liquid and vapor refrigerant, particularly recovered from refrigeration systems. The monitor consists of a sampling reservoir that is connected to an outlet of the container for collecting a sample of the liquid refrigerant. A switch activates inlet and outlet valves of the sampling reservoir, causing them to open and allowing liquid refrigerant from the container to flow into the sampling reservoir. The inlet and outlet valves then close so that a sample of liquid and vapor refrigerant is trapped inside the sampling reservoir. A pressure gauge is disposed between the container and the sample reservoir so that a pressure differential is measured between the vapor pressure of the liquid/vapor refrigerant in the sampling reservoir and the pressure of the container. When the pressure differential reaches a level indicating the container should be vented, the container can be purged by opening an exhaust valve.

DETAILED DESCRIPTION OF THE INVENTION

Figure 1:
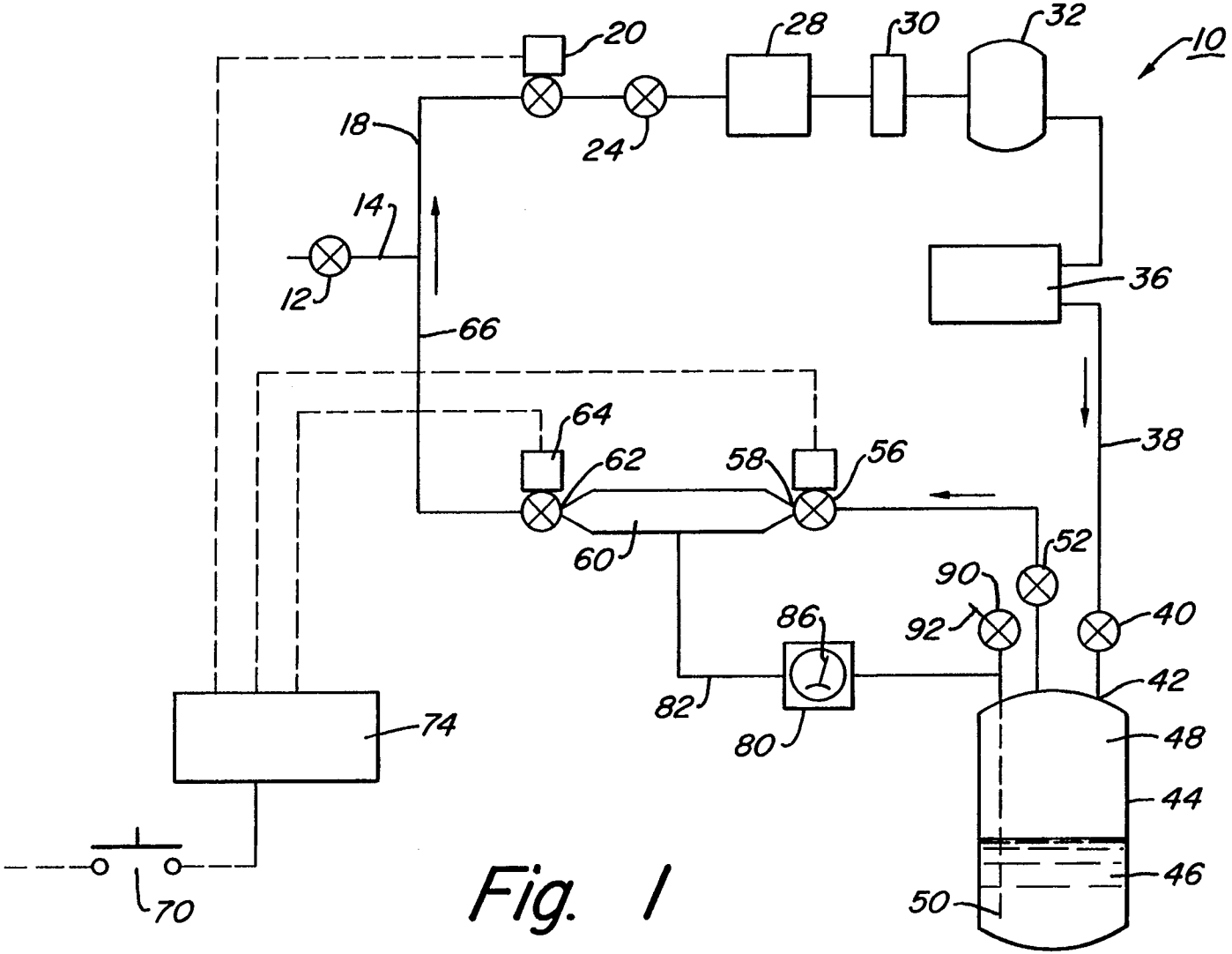
FIG. 1 is a flow diagram of a refrigerant recovery unit with a trapped air monitor constructed in accordance with this invention.

A flow diagram of the refrigerant recovery system 10 is shown in FIG. 1. Refrigerant to be recovered is introduced to the refrigerant recovery system 10 by opening valve 12 of supply line 14. The refrigerant flows from supply line 14 through line 18 and through solenoid valve 20, which is open. An expansion valve 24 creates a pressure drop where the refrigerant is vaporized. The refrigerant then enters a heat exchanger or evaporator 28. Heat is transferred to the low pressure refrigerant in the evaporator 28. The refrigerant then passes through line 18 through filter 30 and into compressor 32. Compressor 32 compresses the refrigerant gas before it passes to a condenser 36.

The condenser 36 liquifies the refrigerant where it exits through a liquid feed line 38. Liquid feed line 38 conducts the liquified refrigerant through valve 40, which is open, and through inlet port 42 into a storage container 44.

Once inside the container 44, the refrigerant collects in a lower liquid section 46. Non-condensable vapor, which is mostly air, collects in a vapor section 48 located at the upper portion of the container 44. An amount of saturated vapor from the refrigerant, however, will also collect in this upper portion 48.

An outlet port 50 extends into the liquid section 46 of the container 44. The outlet port 50 draws liquid refrigerant from the container 44 and through valve 52. The liquid refrigerant is conducted through a first solenoid valve 56, which is an inlet valve, connected to inlet 58. The refrigerant flows through inlet 58 and into sampling reservoir or tube 60 where the refrigerant is collected. The sampling reservoir 60 should be large enough so that the flow of refrigerant is not impaired. An outlet 62 allows the liquid refrigerant to flow out of the sampling reservoir through a second solenoid valve 64, which is an outlet valve, connected to a return line 66. Return line 66 leads to valve 20 and expansion valve 24.

A switch 70 provides current to a sampling board 74, which is a printed circuit board. Solid state devices (not shown) on the sampling board 74 direct current to solenoid valves 20, 56 and 64. Sampling board 74 is a conventional circuit containing means, including a timer, for actuating solenoids for valves 20, 56 and 64.

A pressure gauge 80 on line 82 is disposed between the sampling reservoir 60 and the vapor section 48 of the container 44. An indicator 86 indicates the pressure differential between the sampling reservoir 60 and the container 44.

An exhaust valve 90 is connected to purge line 92. Exhaust valve 90 allows the non-condensable vapors to be purged from the storage container 44 through line 92 to the atmosphere.

In operation, the refrigerant from a refrigeration system (not shown) is recovered by opening valve 12 and allowing refrigerant to flow through supply line 14 and along line 18 to solenoid valve 20. Solenoid valve 20 remains open during recovery of the refrigerant. The refrigerant flows through expansion valve 24 where the reduced pressure causes most of the refrigerant to vaporize. Evaporator 28 heats the lower pressure refrigerant, causing further vaporization and heating of the vapor. The vaporized refrigerant passes through filter 30 before entering the compressor 32. The compressor 32 pressurizes the refrigerant and feeds it to condenser 36 where it is liquified. The liquified refrigerant exits the condenser via liquid feed line 38. Valve 40 remains open allowing the refrigerant to flow from the condenser 36 through inlet port 42 and into the vapor section 48 of the container 44.

The liquid refrigerant collects in the lower liquid section 46 of the container 44. When the refrigerant from the refrigeration unit (not shown) has been collected, valve 12 is shut and the refrigerant can be recycled through the recovery system 10 so that contaminants can be removed by filter 30.

During recycling, solenoid valves 56 and 64 are open. Liquid refrigerant, which has been collected in container 44, flows through outlet port 50, through sample reservoir 60 to the expansion valve 24. The refrigerant passes through the expansion valve 24 and flows back to the container 44 as described above. The refrigerant can be recycled several times to insure that most of the contaminants are removed. As the refrigerant is recycled, non-condensable gases or vapors collect in the upper vapor section 48 of the container 44.

In order to determine whether the container 44 should be purged, the recovery system 10 must be shut off so that the evaporator 38, compressor 32 and condenser 36 are no longer operating. Solenoid valves 56, 64 and 20 will close automatically when the system 10 is shut off. With the system 10 shut off, an operator depresses switch 70. The switch 70 causes a pulse of electricity to be sent to the sampling board 74 where the solid state devices (not shown) are activated. The solid state devices direct current to the solenoid valves 56, 64 and 20 causing them to open.

Because the pressure in the sampling reservoir 60, line 66 and line 18 is lower than the pressure in the container 44, liquid refrigerant from the liquid section 46 is drawn into the sampling reservoir 60 by entering through outlet port 50 and through valve 52, which remains open during operation. After a period of time has elapsed, approximately two to ten seconds, solenoid valve 56 closes cutting off the supply of liquid refrigerant fed into the sampling reservoir 60. Solenoid valves 64 and 20 remain open for a slightly longer period of time, preferably in the range of two to ten seconds, allowing the liquid refrigerant to begin vaporizing. This causes a liquid/vapor space to be formed in the sample reservoir 60. Valves 64 and 20 are then closed simultaneously by sampling board 74 trapping the sample of the refrigerant in sample reservoir 60. The trapped refrigerant inside the sample reservoir 60 will reach a liquid/vapor equilibrium having a given saturated vapor pressure. A constant pressure reading on pressure gauge 80, between the sampling reservoir 60 and the vapor section of the container 44, indicates when this liquid/vapor equilibrium has been reached.

The saturated vapor pressure of the refrigerant in the vapor section 48 of the container 44 would be roughly the same as the vapor pressure of the refrigerant in the sampling reservoir 60 if the non-condensable vapor was not present. A higher pressure in the vapor section 48 of the container 44 would therefore indicate the presence of non-condensable vapors in container 44. When the indicator 86 on the pressure gauge 80 indicates that the pressure differential is above a predetermined amount, the operator can open the exhaust valve 90 connected to purge line 92 to exhaust the non-condensable vapors from the vapor section 48. Once purged, recovery and recycling can begin again as discussed above.

There are several advantages to this type of trapped air monitor. The saturated vapor pressure of the sample in the sample reservoir provides a very close approximation of what the saturated vapor pressure of the refrigerant in the container would be if there was no air or non-condensable vapor present. It eliminates the need for using a permanently sealed sample of refrigerant that must be brought to the temperature of the liquid refrigerant in the storage container. Because the sampling reservoir allows an actual sample of the liquid refrigerant to be taken, the sample will already be at the same temperature as the refrigerant in the container. This also allows the recovery system to be used for different types of refrigerant without having to replace the sample as would be required if a permanently sealed sample was used.

The monitor also gives a better determination of how much non-condensable vapor is in the container than those systems which merely rely on measuring elapsed time, fluid levels, flow rates, or that measure the pressure in the container relative to the atmosphere. By measuring the saturated vapor pressure of an actual sample of the refrigerant and comparing it to the vapor pressure in the container, a more accurate determination of the amount of air and non-condensable vapors in the container can be made.

While the invention has been shown in only one of its forms, it should be apparent to those skilled in the art that it is not so limited, but is susceptible to various changes without departing from the scope of the invention.

I claim:

1. In a container for collecting liquid refrigerant having a saturated vapor pressure, the container having an inlet port for receiving the liquid refrigerant, an outlet port for drawing the liquid refrigerant from the container and exhaust means for venting off non-condensable vapor that is collected with the liquid refrigerant, a monitor for determining the amount of non-condensable vapor that is collected in the container with the liquid refrigerant, the monitor comprising:

sampling means connected to the outlet port of the container for collecting a sample of the liquid refrigerant from the container, the sampling means comprising a reservoir having an inlet means for allowing the liquid refrigerant to flow into the reservoir from the container and an outlet means for allowing the liquid refrigerant to flow out of the reservoir, a first valve means movable between open and shut conditions and disposed between the outlet port of the container and the inlet means of the reservoir, and a second valve means movable between open and shut conditions for restricting flow from the outlet means of the reservoir; and pressure gage means for determining a pressure differential between the vapor pressure of the sample in the reservoir and the pressure of the non-condensable vapor in the container.

2. The monitor of claim 1, further comprising:

actuating means for causing the first and second valve means to open and shut so that the sample of the liquid refrigerant can be trapped in the reservoir.

3. In a container for collecting liquid refrigerant having a saturated vapor pressure, the container having an inlet port for receiving the refrigerant, an outlet port for drawing the refrigerant from the container and exhaust means for venting off non-condensable vapor that is collected with the refrigerant, a monitor for determining the amount of non-condensable vapor that is collected in the container with the refrigerant, the monitor comprising:

sampling means connected to the outlet port of the container for collecting a sample of the refrigerant from the container, the sampling means comprising a reservoir having an inlet means for allowing the refrigerant to flow into the reservoir from the container and an outlet means for allowing the refrigerant to flow out of the reservoir, a first valve means movable between open and shut conditions and disposed between the outlet port of the container and the inlet means of the reservoir, and a second valve means movable between open and shut conditions for restricting flow from the outlet means of the reservoir;

pressure gage means for determining a pressure differential between the vapor pressure of the sample in the reservoir and the pressure of the non-condensable vapor in the container; and actuating means for causing the first and second valve means to open and shut so that the sample of refrigerant can be trapped in the reservoir; and control means for controlling the actuating means such that the actuating means shuts the first valve means before the second valve means when receiving a sample of refrigerant during operation.

4. In a refrigerant recovery system where liquid refrigerant is recovered by directing refrigerant through an expansion valve, an evaporator, a compressor, a condenser and then collecting the liquid refrigerant in a container, the liquid refrigerant having a saturated vapor pressure, the container having an inlet port for receiving the liquid refrigerant from the condenser, an outlet port for drawing the liquid refrigerant from the container and exhaust means for venting off non-condensable vapor that is collected with the liquid refrigerant, a monitor for determining the amount of non-condensable vapor that is collected in the container with the liquid refrigerant, the monitor comprising:

a sampling reservoir connected to the outlet port of the container for collecting a sample of the liquid refrigerant from the container, the sampling reservoir having means for allowing the liquid refrigerant to flow into the reservoir from the container and means for allowing the liquid refrigerant to flow from the reservoir to the expansion valve;

an inlet valve connected between the outlet port of the container and an inlet of the sampling reservoir, the inlet valve being movable between open and shut conditions;

an outlet valve connected between an outlet of the sampling reservoir and the expansion valve, the outlet valve being movable between open and shut conditions for restricting flow from the outlet of the reservoir; and a pressure gage disposed between the sampling reservoir and the container for determining a pressure differential between the vapor pressure of the sample in the sampling reservoir and the pressure of the non-condensable vapor in the container.

5. In a refrigerant recovery system where liquid refrigerant is recovered by directing refrigerant through an expansion valve, an evaporator, a compressor, a condenser and then collecting the liquid refrigerant in a container, the liquid refrigerant having a saturated vapor pressure, the container having an inlet port for receiving the refrigerant from the condenser, an outlet port for drawing the refrigerant from the container and exhaust means for venting off non-condensable vapor that is collected with the refrigerant, a monitor for determining the amount of non-condensable vapor that is collected in the container with the refrigerant, the monitor comprising:

a sampling reservoir connected to the outlet port of the container for collecting a sample of the refrigerant from the container, the sampling reservoir having an inlet for allowing the refrigerant to flow into the reservoir from the container and an outlet for allowing the refrigerant to flow from the reservoir to the expansion valve;

an inlet valve connected between the outlet port of the container and the inlet of the sampling reservoir, the inlet valve being movable between open and shut conditions;

an outlet valve connected between the outlet of the sampling reservoir and the expansion valve, the outlet valve being movable between open and shut conditions for restricting flow from the outlet of the reservoir; and a pressure gage disposed between the sampling reservoir and the container for determining a pressure differential between the vapor pressure of the sample in the sampling reservoir and the pressure of the non-condensable vapor in the container; wherein the inlet and the outlet valves are solenoid actuated valves and wherein the monitor further comprises actuating means for causing the inlet and outlet solenoid valves to open and shut; and control means for controlling the actuating means such that the actuating means shuts the inlet solenoid valve before the outlet solenoid valve when receiving a sample of refrigerant during operation.

* * * * *